United States Patent [19]

Guzorek

[11] Patent Number: 5,070,772

[45] Date of Patent: Dec. 10, 1991

[54] VENTER

[75] Inventor: Steven E. Guzorek, Kinston, N.C.

[73] Assignee: Heico, Inc., Lisle, Ill.

[21] Appl. No.: 493,771

[22] Filed: Mar. 15, 1990

[51] Int. Cl.[5] ..... F23L 17/02

[52] U.S. Cl. ..... 454/16; 110/162

[58] Field of Search ..... 98/42.02, 42.13, 78, 98/79, 80; 110/162

[56] References Cited

U.S. PATENT DOCUMENTS

| | | | |
|---|---|---|---|
| 2,987,983 | 6/1961 | Solzman | 98/42.13 X |
| 3,782,303 | 1/1974 | Pfister et al. | 110/162 |
| 4,250,868 | 2/1981 | Frye | 98/42.04 X |
| 4,344,370 | 8/1982 | Smith et al. | 110/162 |
| 4,757,802 | 7/1988 | Guzorek | 126/80 |

FOREIGN PATENT DOCUMENTS

| | | | |
|---|---|---|---|
| 400309 | 12/1969 | Australia | 98/42.13 |
| 53703 | 6/1982 | European Pat. Off. | 110/162 |
| 1424719 | 2/1976 | United Kingdom | 98/42.13 |

*Primary Examiner*—Harold Joyce

*Attorney, Agent, or Firm*—Wood, Phillips, Mason, Recktenwald & VanSanten

[57] ABSTRACT

A draft inducer having a pair of arcuate semi-scrolls within a cylindrical housing defined by a circular inner end plate and a circular outer end plate vertically spaced by a sidewall. A metal conduit element is connected concentrically to the inner end plate and an electric motor is connected adjacent the outer end plate. A fan blower wheel is disposed in the housing coaxially with the conduit element and is drivingly connected to the motor. The semi-scrolls define curved air passages with twin, oppositely directed outlets for discharging fluid flow outdoors at rates minimally effected by ambient wind conditions.

17 Claims, 2 Drawing Sheets

VENTER

TECHNICAL FIELD

This invention relates to a draft inducer for use in appliance outdoor vent systems which provides draft and gas flow and in particular which minimizes the effect of ambient wind conditions upon the air flow rate within the vent system.

PRIOR ART

Draft inducers are commercially available which have a housing and a blower or fan and which can be connected into a vent pipe system from an appliance for providing draft and gas flow. Such draft inducers typically have the blower or fan connected to the vent system outside of the building, and due to negative pressure within the building a flow is induced through the system. This type of installation results in poor flow through the vent system when the blower is exposed to unfavorable ambient wind conditions. This problem can be minimized by placing the blower in a suitably adapted housing.

In U.S. Letters Pat. No. 4,757,802 of Guzorek, which patent is owned by the assignee hereof, a venter is disclosed having a blower housing and motor positioned at one end of a pair of concentric pipes. The outer pipe forms a portion of a blower scroll, which directs exhaust gases drawn though the inner pipe outwardly through a single outlet.

In U.S. Letters Pat. No. 3,782,303 of Pfister et al. a draft inducer is disclosed having a gas directing housing attached to one end of a tubular element which is attached to a flue. The housing contains linear internal channel structure for directing gases received from the flue through opposed gas exhausting outlets. Gases are drawn through the inducer by a powered propeller disposed within the housing.

These prior art devices have achieved limited success in desensitizing the air flow rate within a vent pipe to ambient wind conditions. While the housing structures employed by the prior art provide a modest degree of shielding from the wind, it is desirable to provide a more robust design for effectively drawing air through a vent system.

DISCLOSURE OF INVENTION

The present invention comprehends an improved draft inducer adapted for drawing gases through a vent system and effectively exhausting the gases outdoors, while generating an air flow rate through the vent system which is minimally effected by ambient wind conditions acting at the exhaust outlets of the draft inducer.

In one form, the invention comprehends a draft inducer for a vent system having a cylindrical housing defining a venting chamber and including a pair of arcuate semi-scrolls within the chamber. The semi-scrolls are arranged to define air passageways within the chamber which have spaced apart discharge openings. Structure is provided on the housing for communicating air which is exhausted from a conduit into the venting chamber, against the semi-scrolls and out through the discharge openings.

In one form, each of the semi-scrolls has circular deflecting surfaces for directing air through the chamber.

In the illustrated embodiment, the discharge openings are oppositely directed.

The invention further comprehends the provision of a draft inducer for a vent system, including a cylindrical housing having a center longitudinal axis with two ends and an outer sidewall defining a venting chamber. First and second arcuate semi-scrolls extend between the ends and respectively define first and second air passageways within the venting chamber, with the first and said second semi-scrolls extending from spaced points proximate the center axis to diametrically spaced points adjacent the sidewall and defining oppositely directed discharge openings. An aperture extends through one of the ends concentric with the central axis and structure is provided on the housing for communicating air exhausted from a conduit through the aperture and into the venting chamber, against the semi-scrolls and out through the discharge openings.

In one form the first semi-scroll extends arcuately from a first inner end near the periphery of the central aperture to a radially spaced first outer end at the periphery of the chamber, and the second semi-scroll extends arcuately from a second inner end near the periphery of the central aperture to a radially spaced second outer end at the periphery of the chamber.

In one form of the invention, the first outer end is circumferentially spaced 180 degrees about the aperture from the first inner end, and the second outer end is circumferentially spaced 180 degrees about the aperture from the first inner end.

In one embodiment, the first and second inner ends are circumferentially spaced 180 degrees from each other, such that the first and said second outer ends are circumferentially spaced 180 degrees from each other about the periphery of the chamber, thereby defining the first and said second oppositely directed discharge openings.

In one form, the venting chamber has a vaned member mounted within the chamber for rotation about an axis between the semi-scrolls and having a motor for energization thereof.

The invention comprehends that the motor has a motor casing adjacent one end of the venting chamber and an elongated shaft extending therethrough and secured to the vaned rotary member, and further having structure to cool the motor in operation In one form, the motor cooling structure includes a cap having a corrugated sleeve in heat exchange engagement with a coaxial inner sleeve which encloses the motor casing and further having structure for supplying cooling air to the interior of the motor casing.

In one embodiment, the cool air supplying structure is a motor cooling fan disposed on the motor shaft intermediate the motor casing and said vaned member and longitudinal passages extending through the motor casing through which heat dissipating air is drawn by the motor cooling fan.

The invention further comprehends the provision of a draft inducer for a vent system a cylindrical housing having a center longitudinal axis with two ends and an outer sidewall and defining a venting chamber. Also provided are first and second semi-scrolls arcuate through 180 degrees and concentric with spaced centers of arcuation, the centers being diametrically spaced about the center axis, and defining first and second air passageways extending from throat portions near the center axis to oppositely directed discharge openings at the periphery of the housing. An aperture extends through one of the ends of the housing adjacent the center axis. Structure is provided on the housing for communicating air exhausted from a conduit through the aperture and into the venting chamber, against the semi-scrolls and out through the discharge openings, whereby the exhausted air is expended outdoors such that the effect of ambient wind conditions on the rate of exhaust gas flow through the conduit is minimized.

In one form, the semi-scrolls cooperatively define an arcuate shield extending through 360 degrees about the venting chamber such that radial directed wind is precluded from penetrating the housing and directly interfering with air discharging therefrom.

In one form, the throat portions are adapted to facilitate the outward exhaust of air through the adjacent discharge openings.

In one embodiment, the sidewall is defined by a cylindrical screen intermediate the housing ends and extending about the periphery of the housing.

In one form, the cylindrical screen is welded to the housing.

BRIEF DESCRIPTION OF THE DRAWINGS

Other features and advantages of the invention will be apparent from the following description taken in connection with the accompanying drawings wherein.

BEST MODE FOR CARRYING OUT THE INVENTION

Figure 1:
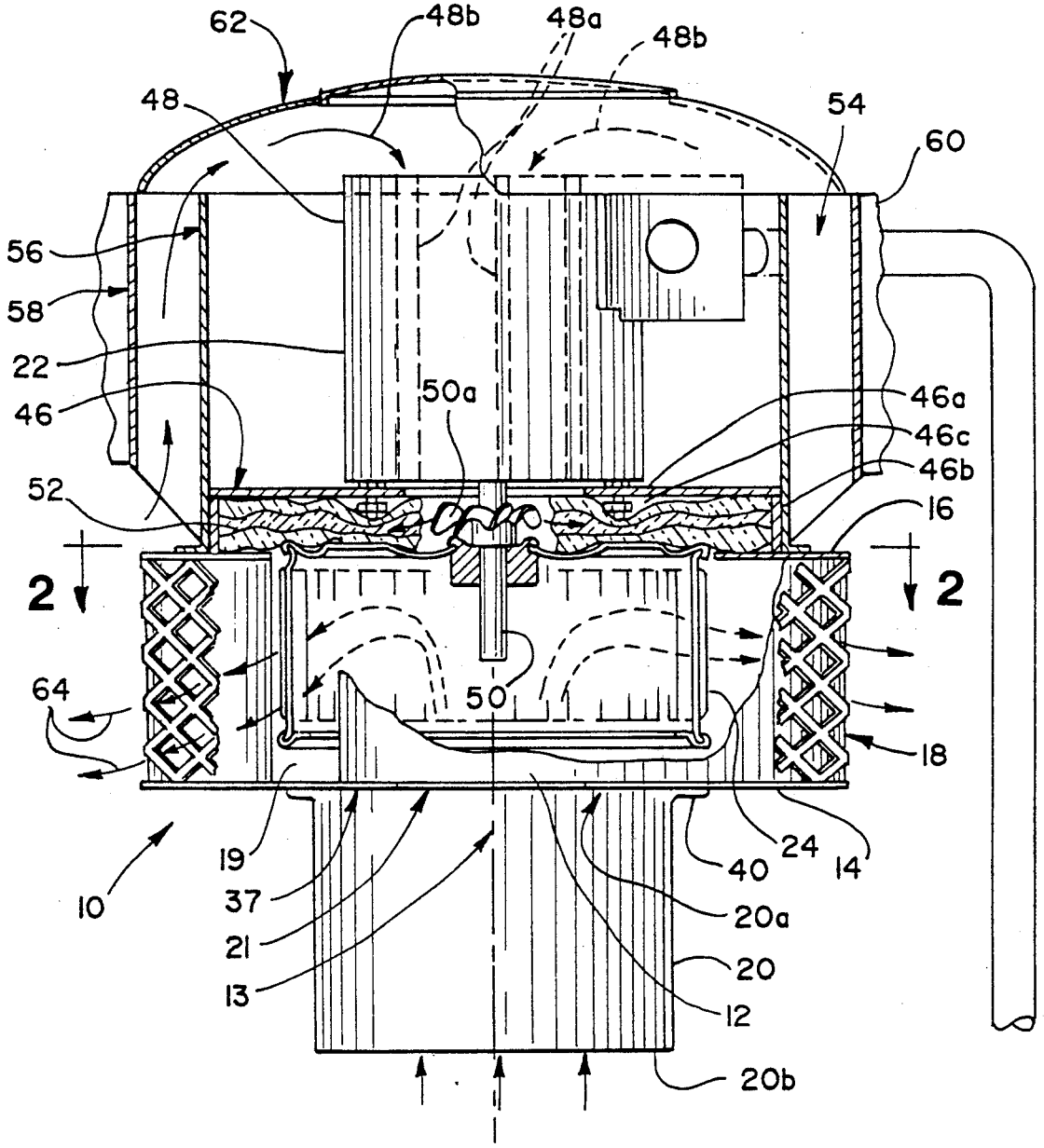
FIG. 1 is a vertical section of an exemplary embodiment of the invention.

In the illustrative embodiment of the invention as disclosed in the drawing, a draft inducer generally designated 10 is shown to comprise a cylindrical housing 12 with a center longitudinal axis 13 and having a circular inner end plate 14 and a circular outer end plate 16 vertically spaced by a peripheral sidewall 18. The end plates 14,16 and sidewall 18 cooperatively define a venting chamber 19. A metal conduit element 20 is connected concentrically to the inner end plate 14 and communicates through a concentric opening 21 in the end plate 14 with the chamber 19. An electric motor 22 is connected to the outer end plate 16 and drivingly engages a vaned blower wheel 24 within the chamber for rotation coaxial with the conduit 20. The housing has a pair of arcuate semi-scrolls 26,28 which define internal passages 30,32 and will be described further below.

The sidewall 18 comprises an apertured cylindrical screen secured between the outer end plate 16 and the inner end plate 14 and extends around the periphery of the housing. The end plates 14,16 are circular metal discs adapted for engagement with the ends of the sidewall as by welding or an otherwise commonly known manner to those skilled in the art.

The conduit element 20 is a metal pipe having an outer end **20*a* and an inner end 20*b*. The outer end 20*a* has an opening 37 having a diameter greater than that of the opening 21 and a circumferential flange 40 which may be secured to the underside of the inner end plate 14 concentric with the opening 21 and thereby in communication with chamber 19**.

Figure 2:
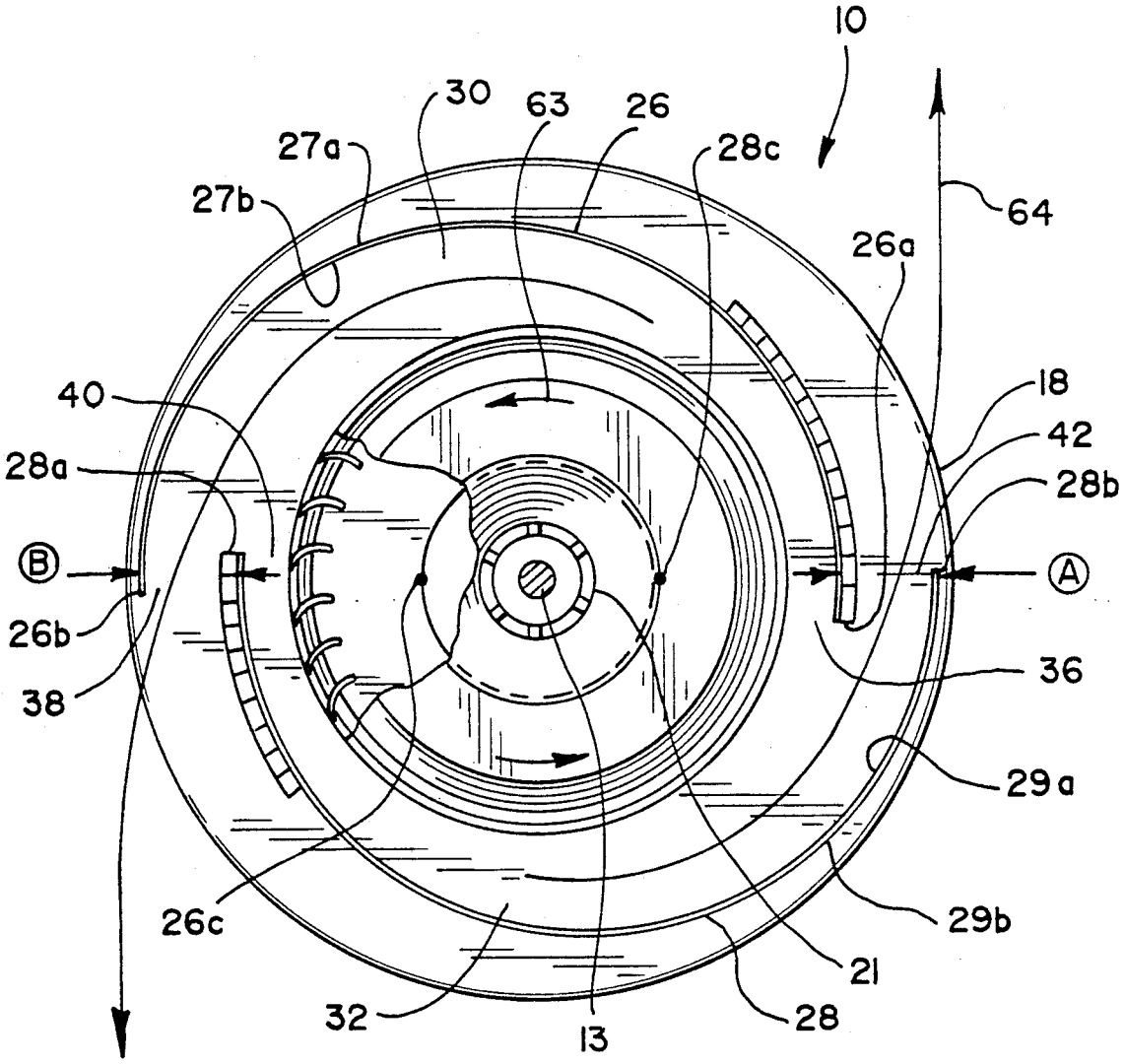
FIG. 2 is a horizontal section of the blower housing taken along the line 1—1 of FIG. 2.

As best shown in FIG. 2, the blower housing contains a pair of curved, oppositely opening semi-scrolls 26,28 which are fixedly positioned about the opening 21 of the housing so as to define internal air passageways 30 and 32. The semi-scrolls 26,28 are metal bands arcuate through at least 180 degrees and extend between the inner end plate 14 and the outer end plate 16. First semi-scroll 26 has an outer surface **27*a* and an inner air deflecting surface 27*b*. Second semi-scroll 28 has an outer surface 29*a* and an inner air deflecting surface 29*b***.

Semi-scroll 26 winds radially outward emanating from a first throat portion 36 adjacent the central opening 21 to a first discharge opening 38 adjacent the sidewall 18, thereby defining passageway 30. In the illustrated embodiment, semi-scroll 26 is semi-circular and arcuate through 180 degrees, extending from an inner end **26*a* at the throat 36 to a radially spaced outer end 26*b* at the discharge opening 38. With this arrangement, the semi-scroll 26 is concentric about a focus point 26*c* radially offset from the center axis 13** of the housing.

Semi-scroll 28 winds radially outward emanating from a second throat portion 40 adjacent the central opening 21 to a second discharge opening 42 adjacent the sidewall 18, thereby defining passageway 32. In the illustrated embodiment, semi-scroll 28 is semi-circular and arcuate through 180 degrees, extending from an inner end **28*a* at the throat 40 to a radially spaced outer end 28*b* at the discharge opening 42. With this arrangement, the semi-scroll 28 is concentric about a focus point 28*c* radially offset from the center axis 13 and diametrically spaced from the focus point 26*c* of the first semi-scroll 26**.

With this arrangement of the semi-scrolls 26,28, the inner end **26*a* of first semi-scroll 26 is radially spaced a distance A from the outer end 28*b* of the second semi-scroll 28, thereby defining the adjacent first throat 36 and second discharge opening 42. The inner end 28*a* of second semi-scroll 28 is radially spaced a distance B from the outer end 26*b* of the first semi-scroll 26, thereby defining the adjacent second throat 40 and first discharge opening 38. This construction provides the discharge openings are oppositely directed, and further that the outer surfaces 27*a*,29*a* of the semi-scrolls 26,28, respectively, cooperatively define a shield arcuate through 360 degrees about the chamber 19 such that external wind is precluded from radially penetrating the housing and directly interfering with the discharge flow through the conduit 20**.

With the semi-scroll configuration shown in FIG. 2, it can be seen that the throat 36 of the passageway 30 has a smaller cross sectional area than that of the adjacent discharge opening 42. Similarly, the throat 40 of the passageway 32 has a smaller cross sectional area than that of the adjacent discharge opening 38. Because of the relatively smaller cross section of the throat areas of the flow passageways, air circulated within the passageways is urged outwardly through the discharge openings rather than through the respective upstream passageways. This feature reduces the potential for exhaust air to be continuously recirculated within the chamber 19 which would result in reduced air flow through the conduit 20.

The fan blower wheel 24 is a bladed circular structure mounted intermediate the throat portions 36,40 of the flow passageways 30,32, respectively, and is coaxial with the central opening 21 and the conduit 20.

In a preferred embodiment, a circular motor mount plate 46 has an outer surface **46*a* and a downturned rim 46*b* and is secured in concentric relation with the outer end plate 14 of the housing. The rim 46*b* axially spaces the outer surface 46*a* from the end plate 14 defining an interior cavity 46*c* therebetween. An electric motor 22** has a motor casing 48 with longitudinal cooling passages 48*a* and an output shaft 50. The motor casing 48 is secured to the outer surface 46*a* of the mount plate 46 and the shaft 50 extends therethrough and into the chamber 19 and is mounted to the fan blower wheel 24 for rotation therewith. The shaft 50 also carries a cooling fan 50*a* within the interior cavity 46*c*. A layer of insulation 52 is provided within the cavity 46*c* and is radially spaced from the cooling fan 50*a*. The cooling fan 50*a* draws ambient air through the cooling passages 48*a* as shown by arrows 48*b* exposing the motor casing 48 to heat dissipating flow. The insulation 52 prevents the motor from being exposed to the damaging high temperatures of hot exhaust gases being drawn through the housing.

Preferably, the motor casing 48 is enclosed within a cover 54 which frictionally embraces the downturned rim 466 of the motor mount plate 46. The cover 54 comprises a pair of concentric spaced metal sleeves 56,58, with the outer sleeve 58 having a plurality of heat dissipating corrugations 60. A cap 62 is provided adjacent the ends of the concentric sleeves 56,58.

Energization of the motor 22 results in rotation of the blower wheel 24 in the direction of the arrows 63 to induce a draft and flow of gas through the conduit 20. The flow is drawn from the conduit 20 through the plate opening 21 and into the throat portions 36,40 of the flow passageways 30 and 32, respectively. As air is continuously drawn through the opening 21, gas is forced against the deflecting surfaces 27*b*,29*b* of the semi-scrolls 26,28, through the passageways 30,32, and outwardly directed through the discharge openings 38 and 42, respectively, as indicated by the arrows 64. The screened sidewall 18 permits air to discharge freely and prevents foreign matter from entering the housing through the discharge openings.

With the draft inducer having oppositely directed discharge openings 38 and 42 and helical internal flow passageways 30 and 32, the draft inducer is extremely well adapted to maintaining maximum flow rates through the conduit 20 while the housing is exposed to high wind loads. Testing has indicated that the twin semi-scroll construction provides improved performance over the twin discharge, linear channel structure and the single scrcll, single opening designs shown in the prior art. Simulated wind loads were applied perpendicular to the discharge openings of each of the embodiments of the present disclosure as well as well as the prior art devices. Results indicate the instant invention provides approximately 50% less total air flow reduction through the conduit in the presence of perpendicular wind loads.

We claim:

1. A draft inducer for a vent system, said draft inducer comprising:

a housing defining a venting chamber having a substantially cylindrical configuration with a central, longitudinal axis and having first and second arcuate semi-scrolls within said venting chamber and defining air passageways with spaced discharge openings;

an exhaust conduit; and means on said housing for communicating air exhausted from the conduit into said venting chamber, against said semi-scrolls and out through said discharge openings, at least one said first and second arcuate semi-scrolls having an inner end adjacent to said conduit for intercepting air exhausted from the conduit and an outer end at which air from the conduit directed against the semi-scroll separates therefrom, said inner and outer ends on the one semi-scroll being at diametrically opposite locations relative to the central axis of the chamber.

2. The draft inducer of claim 1 wherein said first and said second semi-scrolls have curved deflecting surfaces.

3. The draft inducer of claim 2 wherein said discharge openings are oppositely directed.

4. A draft inducer for a vent system, said draft inducer comprising:

a cylindrical housing having a center longitudinal axis with two axially spaced ends and an outer sidewall defining a venting chamber;

first and second arcuate semi-scrolls extending between said ends and respectively defining first and second air passageways within said venting chamber, said first and second semi-scrolls extending from spaced points proximate said center axis to diametrically spaced points adjacent said sidewall and defining oppositely directed discharge openings, at least one of said first and second arcuate semi-scrolls extending through an arc of at least approximately 180° ;

an aperture extending through one of said ends concentric with said central axis; and means on said housing for communicating exhaust air through said aperture and into said venting chamber, against said semi-scrolls and out through said discharge openings.

5. The draft inducer of claim 4 wherein said first semi-scroll extends arcuately from a first inner end near the periphery of said central aperture to a radially spaced from outer end at the periphery of said chamber, and wherein said second semi-scroll extends arcuately from a second liner end near the periphery of said central aperture to a radially spaced second outer end at the periphery of said chamber.

6. The draft inducer of claim 4 wherein said means for communicating exhaust air into said venting chamber comprises a vaned member mounted within said chamber for rotation about an axis between said semi-scrolls and having means for energization thereof.

7. The draft inducer of claim 6 wherein said energization means comprises a motor.

8. The draft inducer of claim 7 wherein said motor has a motor casing adjacent one end of said venting chamber and an elongated shaft extending therethrough and secured to said vaned rotary member, and further having motor cooling means.

9. The draft inducer of claim 8 wherein said motor cooling means includes a cap structure comprising a corrugated sleeve in heat exchange engagement with a coaxial inner sleeve enclosing said motor casing and further having means for supplying cooling air to the interior of said motor casing.

10. The draft inducer of claim 9 wherein said cool air supplying means comprise a motor cooling fan disposed on said motor shaft intermediate said motor casing and said vaned member and longitudinal passages extending through said motor casing through which said motor cooling fan draws heat dissipating air.

11. A draft inducer for a vent system, said draft inducer comprising:

a cylindrical housing having a center longitudinal axis with two ends and an outer sidewall defining a venting chamber;

first and second arcuate semi-scrolls extending between said ends and respectively defining first and second air passageways within said venting chamber, said first and said second semi-scrolls extending from spaced points proximate said center axis to diametrically spaced points adjacent said sidewall and defining oppositely directed discharge openings;

an aperture extending through one of said ends concentric with said central axis; and means on said housing for communicating air exhausted from a conduit through said aperture and into said venting chamber, against said semi-scrolls and out through said discharge openings, wherein said first semi-scroll extends arcuately from a first inner end near the periphery of said central aperture to a radially spaced first outer end at the periphery of said chamber, and wherein said second semi-scroll extends arcuately from a second inner end near the periphery of said central aperture to a radially spaced second outer end at the periphery of said chamber, wherein said first outer end is circumferentially spaced 180 degrees about said aperture from said first inner end, and wherein said second outer end is circumferentially spaced 180 degrees about said aperture from said first inner end.

12. The draft inducer of claim 11 wherein said first and said second inner ends are circumferentially spaced 180 degrees about said central aperture, such that said first and said second outer ends are circumferentially spaced 180 degrees about the periphery of said chamber, thereby defining said first and said second oppositely directed discharge openings.

13. A draft inducer for a vent system, said draft inducer comprising:

a cylindrical housing having a center longitudinal axis with two ends and an outer sidewall and defining a venting chamber;

first and second semi-scrolls arcuate through 180 degrees and concentric with spaced centers of arcuation, said centers being diametrically offset from said center axis, and said semi-scrolls defining first and second air passageways within said chamber and having adjacent throat portions and oppositely directed discharge openings;

a concentric aperture disposed on one of said ends adjacent said center axis and extending therethrough; and means on said housing for communicating air exhausted from a conduit through said aperture and into said venting chamber, against said semi-scrolls and out through said discharge openings, whereby said exhausted air is expended outdoors such that the effect of ambient wind conditions on the rate of exhaust gas flow through the conduit is minimized.

14. The draft inducer of claim 13 wherein said semi-scrolls cooperatively define a shield arcuate through 360 degrees about said chamber such that radial directed wind is precluded from penetrating said housing and directly interfering with air discharging therefrom.

15. The draft inducer of claim 13 wherein said throat portions are adapted to facilitate the outward exhaust of air through said adjacent discharge openings.

16. The draft inducer of claim 13 wherein said sidewall comprises a cylindrical screen intermediate said housing ends and extending about the periphery of said housing.

17. The draft inducer of claim 14 wherein said cylindrical screen is welded to said housing.

* * * * *